US008997755B2

(12) United States Patent
Norman et al.

(10) Patent No.: US 8,997,755 B2
(45) Date of Patent: Apr. 7, 2015

(54) FILTER ELEMENT COMPRISING SMOKE-ALTERING MATERIAL

(75) Inventors: Alan Benson Norman, Clemmons, NC (US); Bradley James Ingebrethsen, Long Branch, NJ (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 1483 days.

(21) Appl. No.: 12/616,359

(22) Filed: Nov. 11, 2009

(65) Prior Publication Data

US 2011/0108044 A1 May 12, 2011

(51) Int. Cl.
*A24D 3/04* (2006.01)

(52) U.S. Cl.
CPC . *A24D 3/048* (2013.01); *A24D 3/04* (2013.01)

(58) Field of Classification Search
USPC ..... 131/334, 344, 341, 331, 342
See application file for complete search history.

(56) References Cited

U.S. PATENT DOCUMENTS

| | | | | |
|---|---|---|---|---|
| 2,881,770 | A | | 4/1959 | Touey |
| 3,101,723 | A | | 8/1963 | Seligman |
| 3,236,244 | A | | 2/1966 | Irby, Jr. et al. |
| 3,272,687 | A | * | 9/1966 | Harrington, Jr. et al. ..... 442/411 |
| 3,311,519 | A | | 3/1967 | Touey et al. |
| 3,313,306 | A | | 4/1967 | Berger et al. |
| 3,347,247 | A | | 10/1967 | Lloyd |
| 3,349,780 | A | | 10/1967 | Sublett et al. |
| 3,370,595 | A | | 2/1968 | Davis et al. |
| 3,413,982 | A | | 12/1968 | Sublett et al. |
| 3,424,172 | A | | 1/1969 | Neurath et al. |
| 3,551,256 | A | | 12/1970 | Watson |
| 3,972,335 | A | | 8/1976 | Tiggelbeck et al. |
| 4,182,348 | A | | 1/1980 | Seehofer et al. |
| 4,281,671 | A | | 8/1981 | Bynre et al. |
| 4,317,460 | A | | 3/1982 | Dale et al. |
| 4,714,082 | A | | 12/1987 | Banerjee et al. |
| 4,756,318 | A | | 7/1988 | Clearman et al. |

(Continued)

FOREIGN PATENT DOCUMENTS

| | | |
|---|---|---|
| AU | B-17855/95 | 1/1996 |
| EP | 0 579 410 A1 | 1/1994 |

(Continued)

OTHER PUBLICATIONS

Gardner et al., "A Safer Cigarette", *Inhalation Toxicology*, 2000, pp. 1-48, vol. 12, Supp. 5.

*Primary Examiner* — Richard Crispino
*Assistant Examiner* — Dionne Walls Mayes
(74) *Attorney, Agent, or Firm* — Womble Carlyle Sandridge & Rice, LLP

(57) ABSTRACT

The invention provides a filter element of a smoking article having a longitudinal axis and adapted for filtration of mainstream smoke generated by the smoking article, the filter element including a first region extending along the longitudinal axis of the filter element and exhibiting a first pressure drop and a second region extending along the longitudinal axis of the filter element and exhibiting a second pressure drop lower than said first pressure drop, wherein the first and second regions are arranged in a side-by-side configuration such that both regions are visible in a cross-section of the filter element perpendicular to the longitudinal axis, and wherein mainstream smoke can move from the second region into the first region, and further comprising a smoke-altering material, such as an oxidation catalyst, positioned in the first region.

20 Claims, 2 Drawing Sheets

(56) References Cited

U.S. PATENT DOCUMENTS

| | | | | |
|---|---|---|---|---|
| 4,771,795 | A | 9/1988 | White et al. | |
| 4,793,365 | A | 12/1988 | Sensabaugh, Jr. et al. | |
| 4,811,745 | A | 3/1989 | Cohen et al. | |
| 4,819,665 | A | 4/1989 | Roberts et al. | |
| 4,862,905 | A | 9/1989 | Green, Jr. et al. | |
| 4,874,004 | A | 10/1989 | Borowski et al. | |
| 4,889,144 | A | 12/1989 | Tateno et al. | |
| 4,917,128 | A | 4/1990 | Clearman et al. | |
| 4,920,990 | A | 5/1990 | Lawrence et al. | |
| 4,924,886 | A | 5/1990 | Litzinger | |
| 4,956,330 | A | 9/1990 | Elliott et al. | |
| 4,966,171 | A | 10/1990 | Serrano et al. | |
| 4,986,287 | A | 1/1991 | Schneider et al. | |
| 5,012,829 | A | 5/1991 | Thesing et al. | |
| 5,025,814 | A | 6/1991 | Raker | |
| 5,027,836 | A | 7/1991 | Shannon et al. | |
| 5,074,320 | A | 12/1991 | Jones, Jr. et al. | |
| 5,101,839 | A | 4/1992 | Jakob et al. | |
| 5,105,835 | A | 4/1992 | Drewett et al. | |
| 5,105,838 | A | 4/1992 | White et al. | |
| 5,211,684 | A | 5/1993 | Shannon et al. | |
| 5,225,277 | A | 7/1993 | Takegawa et al. | |
| 5,240,014 | A | 8/1993 | Deevi et al. | |
| 5,258,340 | A | 11/1993 | Augustine et al. | |
| 5,396,909 | A | 3/1995 | Gentry et al. | |
| 5,404,890 | A | 4/1995 | Gentry et al. | |
| 5,509,429 | A | 4/1996 | Brackmann | |
| 5,568,819 | A | 10/1996 | Gentry et al. | |
| 5,595,577 | A | 1/1997 | Bensalem et al. | |
| 5,718,250 | A | 2/1998 | Banerjee et al. | |
| 5,727,571 | A | 3/1998 | Meiring et al. | |
| 5,730,160 | A | 3/1998 | Schneider | |
| 5,819,751 | A | 10/1998 | Barnes et al. | |
| 5,909,736 | A | 6/1999 | Stavridis et al. | |
| 5,913,311 | A | 6/1999 | Ito et al. | |
| 5,979,459 | A | 11/1999 | Schneider | |
| 6,095,152 | A | 8/2000 | Beven et al. | |
| 6,503,475 | B1 | 1/2003 | McCormick et al. | |
| 7,011,096 | B2 | 3/2006 | Li et al. | |
| 7,152,609 | B2 * | 12/2006 | Li et al. | 131/334 |
| 7,165,553 | B2 | 1/2007 | Luan et al. | |
| 7,228,862 | B2 | 6/2007 | Hajaligol et al. | |
| 7,509,961 | B2 | 3/2009 | Saoud et al. | |
| 7,549,427 | B2 | 6/2009 | Dellinger et al. | |
| 7,560,410 | B2 | 7/2009 | Pillai et al. | |
| 7,566,681 | B2 | 7/2009 | Bock et al. | |
| 7,855,261 | B2 * | 12/2010 | Kuo et al. | 526/318.3 |
| 2002/0014453 | A1 | 2/2002 | Lilly, Jr. et al. | |
| 2002/0166563 | A1 | 11/2002 | Jupe et al. | |
| 2003/0000538 | A1 | 1/2003 | Bereman | |
| 2003/0106562 | A1 | 6/2003 | Chatterjee | |
| 2004/0261807 | A1 | 12/2004 | Dube et al. | |
| 2005/0066981 | A1 | 3/2005 | Crooks et al. | |
| 2005/0066986 | A1 | 3/2005 | Nestor et al. | |
| 2005/0274390 | A1 | 12/2005 | Banerjee et al. | |
| 2006/0090769 | A1 | 5/2006 | Woodson et al. | |
| 2006/0180164 | A1 | 8/2006 | Paine, III et al. | |
| 2006/0219253 | A1 | 10/2006 | Branton et al. | |
| 2007/0000505 | A1 | 1/2007 | Zhuang et al. | |
| 2007/0056600 | A1 | 3/2007 | Coleman, III et al. | |
| 2007/0215168 | A1 | 9/2007 | Banerjee et al. | |
| 2007/0251658 | A1 | 11/2007 | Gedevanishvili et al. | |
| 2009/0084392 | A1 * | 4/2009 | Fiebelkorn | 131/339 |
| 2010/0065075 | A1 | 3/2010 | Banerjee et al. | |
| 2010/0108081 | A1 * | 5/2010 | Blevins Joyce et al. | 131/274 |
| 2010/0108084 | A1 | 5/2010 | Norman et al. | |
| 2010/0122708 | A1 | 5/2010 | Sears et al. | |
| 2010/0125039 | A1 | 5/2010 | Banerjee et al. | |
| 2011/0155154 | A1 | 6/2011 | Zhuang et al. | |
| 2012/0000482 | A1 | 1/2012 | Karles et al. | |

FOREIGN PATENT DOCUMENTS

| | | | |
|---|---|---|---|
| EP | 0 608 047 | A2 | 7/1994 |
| EP | 0 664 964 | A2 | 8/1995 |
| EP | 0 783 841 | | 7/1997 |
| WO | WO 03/009711 | A1 | 2/2003 |
| WO | WO 03/047836 | A1 | 6/2003 |
| WO | WO 03/092416 | A1 | 11/2003 |
| WO | WO 2005/023026 | | 3/2005 |
| WO | WO 2006/051422 | A1 | 5/2006 |
| WO | WO 2006/064371 | A1 | 6/2006 |
| WO | WO 2006/103404 | A1 | 10/2006 |

* cited by examiner

FILTER ELEMENT COMPRISING SMOKE-ALTERING MATERIAL

FIELD OF THE INVENTION

The present invention relates to products made or derived from tobacco, or that otherwise incorporate tobacco, and are intended for human consumption. In particular, the invention relates to filter elements for smoking articles such as cigarettes.

BACKGROUND OF THE INVENTION

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

Certain filter elements for cigarettes contain materials that alter the chemical composition or sensory characteristics of mainstream smoke. For example, it is known to incorporate certain adsorbent materials into a filter element, such as activated carbon or charcoal materials (collectively, carbonaceous materials) in particulate or granular form. Granules of carbonaceous material can be incorporated into "dalmation" types of filter regions using the general types of techniques used for traditional dalmation filter manufacture. Techniques for production of dalmation filters are known, and representative dalmation filters have been provided commercially by Filtrona Greensboro Inc. Alternatively, granules of carbonaceous material can be incorporated into "cavity" types of filter regions using the general types of techniques used for traditional "cavity" filter manufacture. Various types of filters incorporating charcoal particles or activated carbon types of materials are set forth in U.S. Pat. No. 2,881,770 to Touey; U.S. Pat. No. 3,101,723 to Seligman et al.; U.S. Pat. No. 3,236,244 to Irby et al.; U.S. Pat. No. 3,311,519 to Touey et al.; U.S. Pat. No. 3,313,306 to Berger; U.S. Pat. No. 3,347,247 to Lloyd; U.S. Pat. No. 3,349,780 to Sublett et al.; U.S. Pat. No. 3,370,595 to Davis et al.; U.S. Pat. No. 3,413,982 to Sublett et al.; U.S. Pat. No. 3,551,256 to Watson; U.S. Pat. No. 3,602,231 to Dock; U.S. Pat. No. 3,972,335 to Tigglebeck et al.; U.S. Pat. No. 5,360,023 to Blakley et al.; U.S. Pat. No. 5,909,736 to Stpyridis; and U.S. Pat. No. 6,537,186 to Veluz; US Pat. Publication Nos. 2003/0034085 to Spiers et al.; 2003/0106562 to Chatterjee; 2006/0025292 to Hicks et al.; and 2007/0056600 to Coleman, III et al.; PCT WO 2006/064371 to Banerjea et al.; PCT WO 2006/051422 to Jupe et al.; and PCT WO2006/103404 to Cashmore et al., which are incorporated herein by reference.

In another example, oxidation catalysts have been incorporated into a filter element of a smoking article in order to alter the chemistry of mainstream smoke passing through the filter element. In particular, oxidation catalysts that convert carbon monoxide to carbon dioxide are known in the art. Exemplary catalyst materials are set forth in U.S. Pat. No. 4,317,460 to Dale et al.; U.S. Pat. No. 7,549,427 to Dellinger et al; and U.S. Pat. No. 7,560,410 to Pillai et al., which are incorporated herein by reference. Maintaining a high level of smoke-altering catalytic activity can be challenging for certain oxidation catalysts because some catalyst materials are quickly deactivated by exposure to tar or water present in mainstream smoke.

It would be highly desirable to provide a filter element for a smoking article that includes a smoke-altering material capable of altering the chemical makeup or sensory characteristics of mainstream smoke, and which is designed to minimize the negative impact of certain components of mainstream smoke on performance of the smoke-altering material.

SUMMARY OF THE INVENTION

The present invention relates to a filter element for a smoking article such as a cigarette. The smoking article includes a lighting end (i.e., an upstream end) and a mouth end (i.e., a downstream end). A mouth end piece is located at the extreme mouth end of the smoking article, and the mouth end piece allows the smoking article to be placed in the mouth of the smoker to be drawn upon. The mouth end piece has the form of a filter element comprising a smoke-altering material. The filter element of the invention is configured to divert a significant portion of the flow of mainstream smoke away from the smoke-altering material so that the ability of tar and water vapor in the mainstream smoke to foul or deactivate the smoke-altering material is reduced. Although the filter element of the invention is designed to prevent or reduce contamination of the smoke-altering material, the filter element still allows certain gaseous species in the mainstream smoke to interact with the smoke-altering material.

In one aspect, the invention provides a filter element of a smoking article having a longitudinal axis and adapted for filtration of mainstream smoke generated by the smoking article. The filter element comprises a first region extending along the longitudinal axis of the filter element, the first region exhibiting a first pressure drop. The filter element also comprises a second region extending along the longitudinal axis of the filter element, which exhibits a second pressure drop lower than the first pressure drop. The two regions are arranged in a side-by-side configuration such that both regions are visible in a cross-section of the filter element perpendicular to the longitudinal axis (e.g., a coaxial arrangement), and mainstream smoke can move from the second region into the first region. The first region having the higher pressure drop contains a smoke-altering material. The difference in pressure drop between the first region and the second region can be expressed as a ratio, with the ratio of the pressure drop of the first region compared to the second region being at least about 1.5:1, more often at least about 2:1, and most often at least about 2.5:1. The first region may be positioned annularly around the second region.

In one embodiment, the first region comprises a fibrous tow filter material and the second region is an open channel. Optionally, the smoke-altering material can be housed within a chamber or compartment in the first region, wherein the chamber is positioned between two segments of fibrous tow filter material (e.g., an upstream section of fibrous tow filter material and a downstream section of fibrous tow filter material). A semi-permeable barrier layer can be used to retain the smoke-altering material within the first region and block passage of the material into the open channel. The barrier layer is designed to allow passage of gaseous species from the open channel into the chamber containing the smoke-altering material.

In another embodiment, both regions comprise a fibrous tow filter material, such as a plasticized cellulose acetate tow, and the smoke-altering material is embedded in the fibrous tow of the first region. The fibrous tow filter material of the first region (the higher pressure drop region) may comprise filaments having a lower weight per unit length than the filaments of fibrous tow filter material of the second region (the lower pressure drop region). For example, the fibrous tow filter material of the first region may comprise filaments having a weight per unit length that is no more than about 75% of the weight per unit length of the filaments of the second region, more often no more than about 50%, and most often no more than about 25%.

In yet another embodiment, where one or more layers of wrapping material circumscribe the filter element, at least one layer of wrapping material exhibits a diffusivity of at least about 1 cm/sec.

Specific types of smoke-altering materials include flavorants, adsorbents, and oxidation catalysts. Exemplary oxidation catalysts include catalytic metal compounds comprising an element selected from alkali metals, alkaline earth metals, transition metals in Groups IIIB, IVB, VB, VIB VIIB, VIIIB, IB, and IIB, Group IIIA elements, Group IVA elements, lanthanides, and actinides of the Periodic Table of Elements. Exemplary catalytic metal compounds include iron oxides, copper oxide, zinc oxide, cerium oxide, palladium, platinum, rhodium, halides of palladium, platinum or rhodium (e.g., palladium chloride or platinum chloride), or nitrates of palladium, platinum or rhodium (e.g., palladium nitrate or platinum nitrate), or combinations of the foregoing. The smoke-altering material is typically used in powdered or granular form, although other forms (e.g., fibers) could also be used.

In one embodiment, the filter element of the invention has a longitudinal axis and is adapted for filtration of mainstream smoke generated by a smoking article. The filter element comprises an annular region extending along the longitudinal axis of the filter element, which exhibits a first pressure drop, and a central region extending along the longitudinal axis of the filter element and circumscribed by the annular region, wherein the central region exhibits a second pressure drop lower than the first pressure drop. The annular region further includes an oxidation catalyst contained therein. Both the annular region and the central region may comprise a fibrous tow filter material, where the fibrous tow filter material of the annular region comprising filaments having a lower weight per unit length than the filaments of the fibrous tow filter material of the central region.

In another aspect, the invention provides a cigarette comprising a tobacco rod having a smokable filler material contained within a circumscribing wrapping material and a filter element according to the invention connected to the tobacco rod at one end of the tobacco rod.

BRIEF DESCRIPTION OF THE DRAWINGS

In order to assist the understanding of embodiments of the invention, reference will now be made to the appended drawings, which are not necessarily drawn to scale. The drawings are exemplary only, and should not be construed as limiting the invention.

DETAILED DESCRIPTION OF THE PREFERRED EMBODIMENTS

Figure 1:
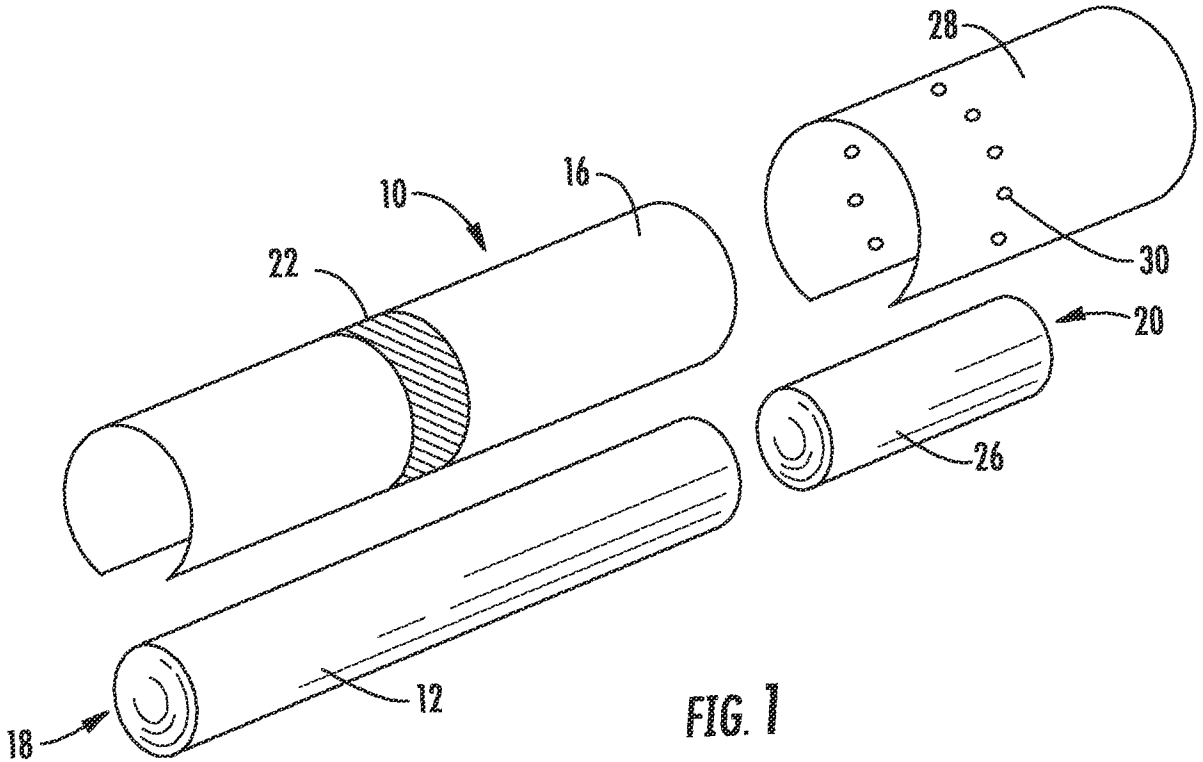
FIG. 1 is an exploded perspective view of a smoking article having the form of a cigarette, showing the smokable material, the wrapping material components, and the filter element of the cigarette.

The present inventions now will be described more fully hereinafter with reference to the accompanying drawings. The invention may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural referents unless the context clearly dictates otherwise.

In certain embodiments, the invention provides a filter element for a smoking article configured to control flow of mainstream smoke through the filter element in a manner that provides advantageous contact between mainstream smoke and a smoke-altering material present in the filter element. For example, certain embodiments of the invention provide a filter element where mainstream smoke is primarily channeled through a region devoid of smoke-altering material, which prevents or reduces contamination or deactivation of the smoke-altering material that can result from contact with tar or water vapor present in mainstream smoke. The smoke-altering material is segregated in a region adjacent to the primary mainstream smoke channel so that diffusion of certain gaseous components from the primary mainstream smoke channel into the region containing the smoke-altering material can occur. In this manner, the invention provides a filter design that enables the smoke-altering material to interact with certain gaseous species within mainstream smoke without contacting the full stream of mainstream smoke.

As used herein, the term "smoke-altering material" refers to any material capable of altering the composition of mainstream smoke passing through the filter element, such as by adsorption of certain gaseous species (e.g., removal of organic compounds), by chemical reaction with certain gaseous species (e.g., oxidation of carbon monoxide), or by addition of volatile, gaseous components (e.g., addition of a flavorant to the smoke). The smoke-altering material is typically utilized in a form that can be described as powered or granular, although other forms, such as fibers, could be used without departing from the invention. Combinations of smoke-altering material could be used in the same filter, including combinations of materials of different type such as a combination of an adsorbent and a flavorant.

Exemplary types of smoke-altering material include adsorbents, such as activated carbon and ion exchange resins, and flavorants, including flavorant-containing capsules and solid botanical additives such as peppermint or spearmint leaves or other plant-based flavorants in particulate form. Examples of suitable activated carbon materials include activated coconut hull based carbons and coal-based carbons available from Calgon Corp., wood-based carbons available from Westvaco, and AMBERSORB resins available from Rohm and Haas. Exemplary ion exchange resins include DIAION® ion-exchange resins available from Mitsubishi Chemical Corp. (e.g., WA30 and DCA11), DUOLITE® ion exchange resins available from Rohm and Haas (e.g., DUOLITE® A7), and XORBEX resins available from Dalian Trico Chemical Co. of China.

In another embodiment, the smoke-altering material is an oxidation catalyst capable of oxidizing one or more gaseous species present in mainstream smoke, such as carbon monoxide, $NO_X$, hydrogen cyanide, catechol, hydroquinone, or certain phenols. The oxidation catalyst used in the invention is typically a catalytic metal compound that oxidizes one or more gaseous species of mainstream smoke having a molecular weight of less than about 110 Da, more often less than about 75 Da, and most often less than about 50 Da or less than about 40 Da. Although not bound by any particular theory of operation, it is believed that the filter elements of the invention are particularly well-suited for oxidation of relatively small molecular weight gaseous species.

As used herein, "catalytic metal compound" refers to a metal-containing compound that can either directly react with one or more gas phase components of mainstream smoke generated by a smoking article or catalyze a reaction involving a gas phase component of mainstream smoke or both, such that concentration of the gas phase component is reduced. For example, certain catalytic metal compounds can catalyze the oxidation of CO to $CO_2$ in the presence of oxygen in order to reduce the level of CO in mainstream smoke. In US 2007/0215168 to Banerjee et al., which is incorporated by reference herein in its entirety, smoking articles comprising cerium oxide particles are described. The cerium oxide particles reduce the amount of carbon monoxide emitted during use of the smoking articles. Additional catalytic metal compounds are described in U.S. Pat. No. 4,182,348 to Seehofer et al; U.S. Pat. No. 4,317,460 to Dale et al.; U.S. Pat. No. 4,956,330 to Elliott et al.; U.S. Pat. No. 5,050,621 to Creighton et al.; U.S. Pat. No. 5,258,340 to Augustine et al.; U.S. Pat. No. 6,503,475 to McCormick; U.S. Pat. No. 6,503,475 to McCormick, U.S. Pat. No. 7,011,096 to Li et al.; U.S. Pat. No. 7,152,609 to Li et al.; U.S. Pat. No. 7,165,553 to Luan et al.; U.S. Pat. No. 7,228,862 to Hajaligol et al.; U.S. Pat. No. 7,509,961 to Saoud et al.; U.S. Pat. No. 7,549,427 to Dellinger et al.; U.S. Pat. No. 7,560,410 to Pillai et al.; and U.S. Pat. No. 7,566,681 to Bock et al.; and US Pat. Publication Nos. 2002/0167118 to Billiet et al.; 2002/0172826 to Yadav et al.; 2002/0194958 to Lee et al.; 2002/014453 to Lilly Jr., et al.; 2003/0000538 to Bereman et al.; 2005/0274390 to Banerjee et al.; and 2007/0251658 to Gedevanishvili et al., as well as U.S. application Ser. No. 12/233,192 filed Sep. 18, 2008 to Banerjee et al., Ser. No. 12/274,780 filed Nov. 20, 2008 to Banerjee et al., and Ser. No. 12/274,818 filed Nov. 20, 2008 to Sears et al., all of which are incorporated by reference herein in their entirety.

Examples of the metal component of the catalytic metal compound include, but are not limited to, alkali metals, alkaline earth metals, transition metals in Groups IIIB, IVB, VB, VIB VIIB, VIIIB, IB, and IIB, Group IIIA elements, Group IVA elements, lanthanides, and actinides. Specific exemplary metal elements include Ti, Zr, Hf, V, Nb, Ta, Cr, Mo, W, Mn, Re, Fe, Co, Ni, Ru, Rh, Pd, Os, Ir, Pt, Cu, Ag, Au, Zn, Y, Ce, Na, K, Cs, Mg, Ca, B, Al, Si, Ge, and Sn. Catalytic metal compounds can be used in a variety of solid particulate forms including precipitated metal particles, metal oxide particles (e.g., iron oxides, copper oxide, zinc oxide, and cerium oxide), and supported catalyst particles wherein the catalytic metal compound is dispersed within or coated on a porous supporting material, such as activated carbon, aluminum oxide, copper oxide, or titanium oxide. Combinations of catalytic metal compounds can be used, such as a combination of a palladium catalyst with cerium oxide. The particle size of the catalytic metal compounds can vary, but is typically between about 1 nm to about 20 microns, with the unsupported catalyst materials typically located in the lower end of the range (e.g., about 1 nm to about 1 micron) and the catalyst material comprising a supporting scaffold located in the higher end of the range (e.g., about 5 microns to about 20 microns). The amount of loading of the catalyst material onto a supporting substrate can vary, but will typically be from about 0.2 percent to about 10.0 percent, based on the total dry weight of the coated substrate.

The amount of catalytic metal compound incorporated into the filter element can vary. For example, the amount typically incorporated within a representative filter element can range from about 0.1 mg to about 200 mg. Generally, that amount is at least about 1 mg, and often at least about 5 mg. Typically, the amount does not exceed about 100 mg, and often does not exceed about 50 mg. Frequently, the amount can be from about 5 mg to about 20 mg.

Regarding the use of combinations of catalytic metal compounds, one exemplary combination is a combination of a catalyst metal compound in the form of an oxide with a Group VIIIB catalytic metal compound such as palladium, platinum, rhodium, halides thereof (e.g., palladium chloride or platinum chloride), or nitrates thereof (e.g., palladium nitrate or platinum nitrate). The two components can be separately incorporated into a filter element or pre-mixed prior to incorporation. Generally, the ratio between the amount of Group VIIIB metal (or metal halide or nitrate) to the amount of the second catalyst metal compound ranges from about 1:2 to about 1:10,000, on a weight basis.

The filter element of the invention comprises two adjacent longitudinally-extending regions characterized by different pressure drops. The region with the lower pressure drop (i.e., the region with the lesser resistance to draw) is utilized as the main conduit for mainstream smoke through the filter element. A second adjacent region characterized by a higher pressure drop (i.e., a greater resistance to draw) contains the smoke-altering material. The two regions are aligned in a side-by-side relationship along the axis of the filter element such that a cross-section of the filter element taken through a plane perpendicular to the longitudinal axis of the filter element would cut through both regions. In other words, one region is not positioned upstream of the other. In the embodiment set forth in the accompanying figures, the two regions are coaxial. However, coaxial arrangement is not required. The two regions could be arranged in a side-by side manner without sharing the same axis. For example, the two regions could each have a semicircular cross-section.

The cross-sectional area of each region can vary. Typically, the ratio of cross-sectional area of the first region as compared to the second region is about 2:1 to about 1:2, more often about 1.5:1 to about 1:1.5, and most often about 1:1.

The two regions are in fluid communication, meaning gaseous components of mainstream smoke can pass from one region to the other. In this manner, gaseous components of mainstream smoke passing through the region exhibiting the lower pressure drop can pass into the adjacent region containing the smoke-altering material.

Typically, pressure drop values of cigarettes are measured using a Filtrona Cigarette Test Station (CTS Series) available form Filtrona Instruments and Automation Ltd. Pressure drop can be expressed as mm of water required to draw 17.5 cc/sec of air through or across the filter region from the tobacco rod side to the mouth end of the filter element. The difference in pressure drop between the first region and the second region can be expressed as a ratio, with the ratio of the pressure drop of the first region compared to the second region being at least about 1.5:1, more often at least about 2:1, and most often at least about 2.5:1. In certain embodiments, the ratio can be at least about 3:1 or at least about 3.5:1. An exemplary range for the pressure drop in the first region is about 50 to about 300 mm of water and an exemplary range for the pressure drop in the second region is about 0 to about 100 mm of water. In one exemplary embodiment, the first region exhibits a pressure drop of about 100 mm of water and the second region exhibits a pressure drop of about 33 mm of water. In another embodiment, the first region exhibits a pressure drop of about 50 mm of water and the second region exhibits a pressure drop of about 17 mm of water. In yet another embodiment, the first region exhibits a pressure drop of about 200 mm of water and the second region exhibits a pressure drop of about 66 mm of water.

Establishing a difference in pressure drop between the regions can be accomplished in a number of ways. For example, the lower pressure drop region could be a free-flow open channel through the filter element, thus providing extremely low resistance to draw. In such an embodiment, the higher pressure drop region could be constructed of a conventional fibrous tow filter material. In another embodiment, both regions are made using fibrous tow filter materials, with each region comprising filaments having different properties that alter the pressure drop through the region. For instance, the cross-sectional shape of the filaments can be adjusted to change pressure drop. Conventional fibrous tow materials for cigarette manufacture typically comprise filaments with a Y or X cross-sectional shape, which increases pressure drop. In the lower pressure drop region, filaments with a round cross-section could be used in order to reduce pressure drop through the region. Alternatively, the denier per filament (i.e., dpf where denier is expressed in units of g/9000 m) of each region, which is a measurement of the weight per unit length of the individual filaments of the tow, could be manipulated to achieve the desired difference in pressure drop. For example, the fibrous tow filter material of the first region may comprise filaments having a weight per unit length that is no more than about 75% of the weight per unit length of the filaments of the second region, more often no more than about 50%, and most often no more than about 25%. An exemplary dpf range for the fibrous tow used in the filter element of the invention is about 1.5 to about 8. An exemplary range of total denier for fibrous tow used in the present invention is about 20,000 to about 50,000 (e.g., about 35,000 or about 40,000 total denier). Still further, two different filtration materials with different pressure drop characteristics could be used, such as a fibrous tow in one region and a gathered web or gathered paper material in the other region.

Several exemplary embodiments of filter elements of the invention will be described with reference to the accompany figures. For ease of reference, the smoke-altering material in these embodiments will be described as an oxidation catalyst; however, other smoke-altering material could be used without departing from the invention as explained herein.

Referring to FIG. 1, there is shown a smoking article 10 in the form of a cigarette and possessing certain representative components of a smoking article of the present invention. The cigarette 10 includes a generally cylindrical rod 12 of a charge or roll of smokable filler material contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. That is, the band 22 provides a cross-directional region relative to the longitudinal axis of the cigarette. The band 22 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter element 26. The filter element 26 positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough.

Figure 2A:
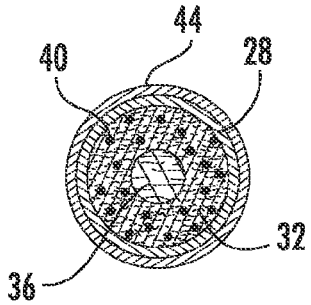
FIGS. 2A and 2B provide an end view and a cross-sectional view, respectively, of one embodiment of a filter element according to the invention comprising an annular first region of filter material and a central second region of filter material.
Figure 2B:
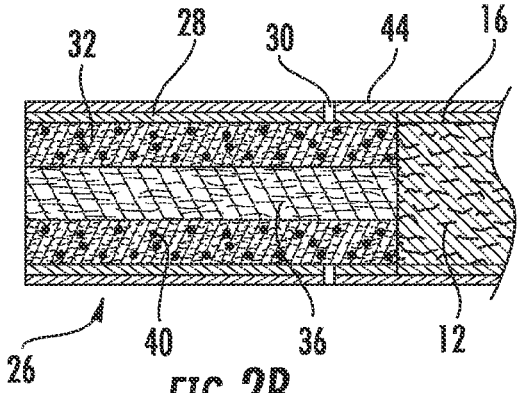

An exemplary filter element 26 configuration is shown in FIGS. 2A and 2B; the filter including a first longitudinally-extending filter segment 32 and a second longitudinally-extending filter segment 36, the two filter segments arranged coaxially with the first filter segment having an annular shape and surrounding the second filter segment. Each segment of filter material 32, 36 comprises a fibrous tow filter material (e.g., cellulose acetate tow impregnated with a plasticizer such as triacetin), with the outer or annular filter segment 32 exhibiting a higher pressure drop than the central filter segment 36. The outer filter segment 32 also comprises a plurality of oxidation catalyst particles 40 dispersed therein. The central filter segment 36 is typically substantially free of oxidation catalyst or other smoke-altering materials (e.g., containing less than about 0.5 weight percent of such materials based on the total weight of the filter segment) and often completely free of such materials.

The filter element 26 is circumscribed along its outer circumference or longitudinal periphery by a layer of outer plug wrap 28, which overlies the annular filter segment 32. The filter element 26 is attached to the tobacco rod 12 using tipping material 44 that circumscribes both the entire length of the filter element 26 and an adjacent region of the tobacco rod 12. The inner surface of the tipping material 44 is fixedly secured to the outer surface of the plug wrap 28 and the outer surface of the wrapping material 16 of the tobacco rod, using a suitable adhesive; and hence, the filter element and the tobacco rod are connected to one another.

A ventilated or air diluted smoking article can be provided with an optional air dilution means, such as a series of perforations 30, each of which extend through the tipping material 44 and plug wrap 28. The optional perforations 30 can be made by various techniques known to those of ordinary skill in the art, such as laser perforation techniques. Alternatively, so-called off-line air dilution techniques can be used (e.g., through the use of porous paper plug wrap and pre-perforated tipping paper). For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the level of air dilution for an air diluted cigarette is less than about 80 percent, and often less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette.

During use, the smoker lights the lighting end 18 of the cigarette 10 using a match or cigarette lighter. As such, the smokable material 12 begins to burn. The mouth end 20 of the cigarette 10 is placed in the lips of the smoker. Thermal decomposition products (e.g., components of tobacco smoke) generated by the burning smokable material 12 are drawn through the cigarette 10, through the filter element 26, and into the mouth of the smoker. Due to the difference in pressure drop between the annual filter segment 32 and the central filter segment 36, the mainstream smoke will preferentially travel through the central segment of the filter. However, certain gaseous components of mainstream smoke will be able to diffuse into the outer filter segment 32 where such gaseous components will interact with the oxidation catalyst particles 40. Interaction with the oxidation catalyst particles 40 can result in changes in the chemical makeup of the smoke traveling through the filter. Since mainstream smoke will preferentially travel through the central segment 36 of the filter, contact between the tar and water vapor in mainstream smoke and the oxidation catalyst particles 40 will be avoided or minimized, which can reduce fouling or deactivation of the catalyst particles.

Figure 3:
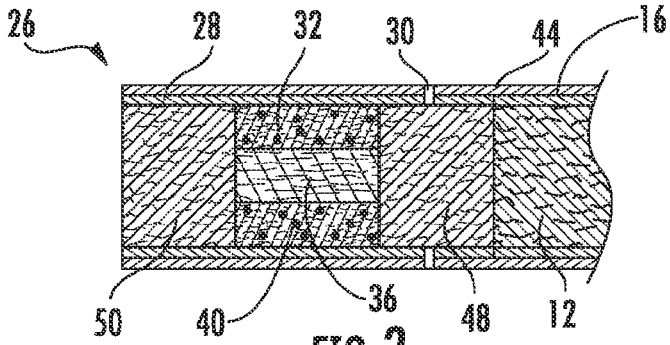
FIG. 3 is a cross-sectional view of another embodiment of a filter element according to the invention comprising additional mouth end and tobacco end segments of filter material.

FIG. 3 illustrates another filter element 26 embodiment that includes additional filter segments at both the mouth end and the tobacco end of the filter element. The central segment of the filter element 26 comprises the annular segment 32 and central segment 36 as described in connection with FIGS. 2A and 2B. In addition, the illustrated embodiment includes conventional fibrous tow filter segments 48, 50 positioned upstream and downstream from the coaxial section of the filter element 26. The filter element 26 could also include only one of the tobacco end filter segment 48 and the mouth end filter segment 50, instead of both. The filter element 26 could also include additional filter segments, such as a total of 1-6 filter element segments, typically 2-4 segments.

Figure 4:
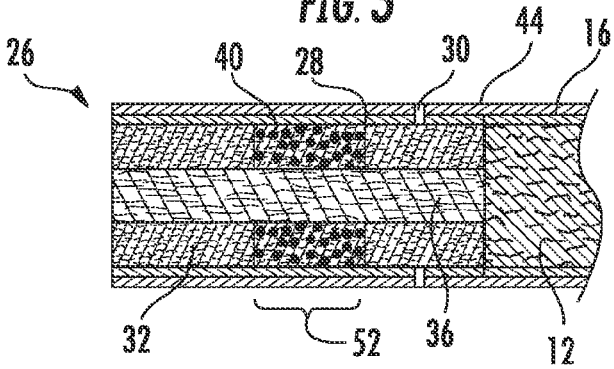
FIG. 4 is a cross-sectional view of another embodiment of a filter element according to the invention where the smoke-altering material is confined to a central location in the annular region of the filter element.

FIG. 4 illustrates yet another embodiment where the oxidation catalyst particles 40 are only present in a portion 52 of annular filter segment 32. Although the portion 52 containing the particles 40 is centrally-located in the figure, other locations closer to the mouth end or tobacco end of the filter element 26 could also be used.

Although the annular region 32 in FIGS. 2-4 is depicted as the region containing the oxidation catalyst particles 40 and exhibiting the higher pressure drop, the invention is not limited to such embodiments. Filter element configurations where the annular region is the lower pressure drop region and the central region contains the oxidation catalyst particles (or other smoke-altering material) could also be used without departing from the invention.

Figure 5A:
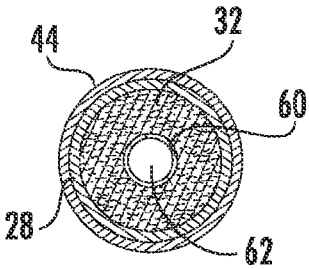
FIGS. 5A and 5B provide an end view and a cross-sectional view, respectively, of yet another embodiment of a filter element according to the invention comprising a central open channel and an annular region that includes a chamber containing the smoke-altering material.
Figure 5B:
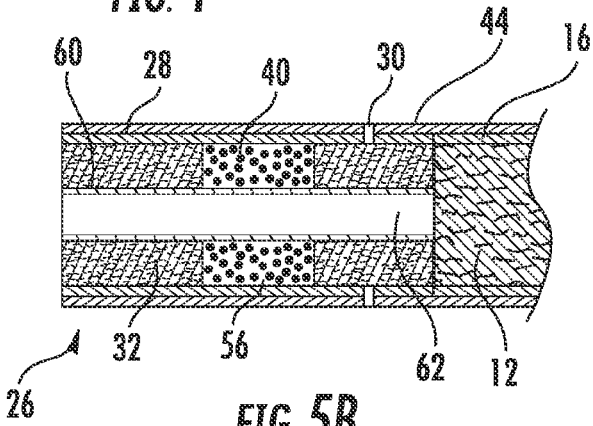

FIGS. 5A and 5B illustrate another embodiment where the central region of the filter element 26 is a free-flow open channel 62. An annular segment 32 surrounds the channel 62 and can be constructed, for example, of a fibrous tow filter material. The annular segment 32 defines a chamber 56, which is centrally located in the illustration but could also be positioned closer to one of the ends of the filter element 26. The chamber 56 contains a plurality of oxidation catalyst particles 40. The channel 62 is surrounded by a barrier layer 60 that prevents migration of the particles 40 from the chamber 56 into the channel. The barrier layer 60 can be constructed of any semi-permeable material capable of allowing penetration by gaseous components of mainstream smoke, but retaining the particles 40 within the chamber. Exemplary barrier materials include paper and fibrous tow.

The filter element configurations of FIGS. 4 and 5 could also be modified by addition of a mouth end segment of filter material or a tobacco end segment of filter material as shown in FIG. 3.

Various types of cigarette components, including tobacco types, tobacco blends, top dressing and casing materials, blend packing densities and types of paper wrapping materials for tobacco rods, can be employed. See, for example, the various representative types of cigarette components, as well as the various cigarette designs, formats, configurations and characteristics, that are set forth in Johnson, Development of Cigarette Components to Meet Industry Needs, 52$^{nd}$ T.S.R.C. (September, 1998); U.S. Pat. No. 5,101,839 to Jakob et al.; U.S. Pat. No. 5,159,944 to Arzonico et al.; U.S. Pat. No. 5,220,930 to Gentry and U.S. Pat. No. 6,779,530 to Kraker; US Patent Publication Nos. 2005/0016556 to Ashcraft et al.; 2005/0066986 to Nestor et al.; 2005/0076929 to Fitzgerald et al.; 2006/0272655 to Thomas et al.; 2007/0056600 to Coleman, III et al.; and 2007/0246055 to Oglesby, each of which is incorporated herein by reference. Most preferably, the entire smokable rod is composed of smokable material (e.g., tobacco cut filler) and a layer of circumscribing outer wrapping material.

The wrapping material used as the tipping material and the plug wrap (i.e., the outer wrapping layers of the filter element 26) can be constructed using conventional materials. In one embodiment, one or more of the layers of wrapping material surrounding the filter element is a diffuse material (e.g., a diffuse plug wrap or diffuse tipping material). In diffuse wrapping material embodiments, the diffusivity of the wrapping material will most preferably be similar to that of standard cigarette wrapping material such as, for example, the material 16 (e.g., a diffusivity of about 2 cm/sec, or a base porosity of about 15 to about 80 CORESTA) or similar materials of the type commonly used around a tobacco charge in a cigarette. Exemplary embodiments will have a single layer of diffuse tipping material and porous or no plug wrap. Diffuse wrapping material will be greater than 0 CORESTA and less than 100 CORESTA, with a preferred range between about 5 to about 80 CORESTA, and a diffusivity of at least about 1 cm/sec, preferably at least about 1.5 cm/sec. Diffusivity may be measured using techniques such as, for example, those disclosed in US Pat. App. Pub. 2005/0087202 to Norman et al., which is incorporated herein by reference. This differs significantly from typical tipping or plug wrap materials, which may provide little or no diffusivity (e.g., about 0 cm/sec, commonly less than about 1 cm/sec, or a base porosity of less than about 10 CORESTA). For cigarette embodiments including diffuse wrapping material around the filter element, the wrapping material may be selected from a number of paper or paper-like materials. In one example, a typical wrapping material of the type commonly used to contain a tobacco charge may be used. Such a wrapping material will most preferably include a desirable diffusivity (e.g., sometimes greater than 1 cm/sec, preferably greater than about 1.5 cm/sec, often about 1 to about 3 cm/sec, and frequently about 2 cm/sec). Wrapping materials having a high degree of diffusivity are described in U.S. patent application Ser. No.

12/263,031 to Norman et al., filed Oct. 31, 2008, which is incorporated by reference herein in its entirety. Although not bound by any particular theory of operation, it is believed that the use of wrapping materials having a high degree of diffusivity may provide advantageous flow characteristics through the bed of smoke-altering material in the filter element of the invention.

Various methods for specific placement of continuous and discontinuous adhesive seams during manufacturing processes are commonly used, and new methods are forthcoming as well (see, e.g., U.S. patent application Ser. No. 12/101,529 to Pipes et al.). Although placement of adhesive in this manner for filter element wrapping processes may use adhesives that limit or diminish diffusivity in a region where applied, it will be appreciated that one or more "diffuse as applied" adhesives may be used on part or all of the inner surface of filter element wrapping material that do not significantly limit or diminish diffusivity of the wrapping material in a region where applied. Such adhesives preferably provide a porous or otherwise diffuse surface allowing passage of air therethrough while simultaneously providing desirable adhesive traits. Representative adhesives that are useful for applying wrapping materials to cigarette components are available as Reference Nos. 32-2049 and 32-2124 from National Starch & Adhesives Corp. See also, for example, Skeist, Handbook of Adhesives, $2^{nd}$ Edition (1977); Schneberger, Adhesive in Manufacturing (1983); Gutcho, Adhesives Technology Developments Since 1979 (1983); Landrock, Adhesives Technology Handbook (1985); and Flick, Handbook of Adhesives Raw Materials, $2^{nd}$ Edition (1989).

The filter material utilized in various segments of the filter element (e.g., segments or regions 32, 36, 48, or 50) can vary, and can be any material of the type that can be employed for providing a tobacco smoke filter for cigarettes. Typically, a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary or fibrous tow such as cellulose acetate, polyolefins such as polypropylene, or the like. One filter material that can be used in certain regions of the filter element of the invention is cellulose acetate tow having 3 denier per filament and 40,000 total denier. As another example, cellulose acetate tow having 3 denier per filament and 35,000 total denier can be used in certain regions of the filter element. As another example, cellulose acetate tow having 8 denier per filament and 40,000 total denier can be used in certain regions of the filter element. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.; each of which is incorporated herein by reference. As noted previously, with respect to the coaxial section of the filter element illustrated in the appended figures, each region of the coaxial section can comprise a fibrous tow filter material having different characteristics, such as different filament cross-section, different denier per filament, different cross-sectional area, different tow weight, and the like.

Normally a plasticizer such as triacetin or carbowax is applied to the filamentary tow in traditional amounts using known techniques. In one embodiment, the plasticizer component of the filter material comprises triacetin and carbowax in a 1:1 ratio by weight. The total amount of plasticizer is generally about 4 to about 20 percent by weight, preferably about 6 to about 12 percent by weight. Other suitable materials or additives used in connection with the construction of the filter element will be readily apparent to those skilled in the art of cigarette filter design and manufacture. See, for example, U.S. Pat. No. 5,387,285 to Rivers, which is incorporated herein by reference.

Filamentary tow, such as cellulose acetate, is processed using a conventional filter tow processing unit such as a commercially available E-60 supplied by Arjay Equipment Corp., Winston-Salem, N.C. Other types of commercially available tow processing equipment, as are known to those of ordinary skill in the art, may similarly be used.

Filter element components or segments for filter elements for multi-segment filtered cigarettes typically are provided from filter rods that are produced using traditional types of rod-forming units, such as those available as KDF-2 and KDF-3E from Hauni-Werke Korber & Co. KG. Typically, filter material, such as filter tow, is provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. No. 4,281,671 to Byrne; U.S. Pat. No. 4,862,905 to Green, Jr. et al.; U.S. Pat. No. 5,060,664 to Siems et al.; U.S. Pat. No. 5,387,285 to Rivers; and U.S. Pat. No. 7,074,170 to Lanier, Jr. et al. Other types of technologies for supplying filter materials to a filter rod-forming unit are set forth in U.S. Pat. No. 4,807,809 to Pryor et al. and U.S. Pat. No. 5,025,814 to Raker; which are incorporated herein by reference.

Cigarette filter rods can be used to provide multi-segment filter rods. The production of multi-segment filter rods can be carried out using the types of rod-forming units that traditionally have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany. Representative types of filter designs and components, including representative types of segmented cigarette filters, are set forth in U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones, Jr. et al.; U.S. Pat. No. 5,105,838 to White et al.; U.S. Pat. No. 5,271,419 to Arzonico et al.; U.S. Pat. No. 5,360,023 to Blakley et al.; U.S. Pat. No. 5,396,909 to Gentry et al.; and U.S. Pat. No. 5,718,250 to Banerjee et al; US Pat. Appl. Pub. Nos. 2002/0166563 to Jupe et al., 2004/0261807 to Dube et al.; 2005/0066981 to Crooks et al.; 2006/0090769 to Woodson et al.; 2006/0124142 to Zhang; 2006/0144412 to Mishra et al., 2006/0157070 to Belcastro et al.; and 2007/0056600 to Coleman, III et al.; PCT Publication No. WO 03/009711 to Kim; PCT Publication No. WO 03/047836 to Xue et al.; all of which are incorporated herein by reference.

Multi-segment filter elements typically are provided from so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 4,850,301 to Greene, Jr. et al.; and U.S. Pat. No. 6,229,115 to Vos et al.; and US Patent Application Publication Nos. 2005/0103355 to Holmes, 2005/1094014 to Read, Jr., and 2006/0169295 to Draghetti, each of which is incorporated herein by reference.

Exemplary processes for introducing additives, such as the smoke-altering material described herein, into fibrous filter tow during filter rod formation are set forth in US Patent Application Publication Nos. 2008/0029118 to Nelson et al. and 2008/0302373 to Stokes et al., as well as in U.S. application Ser. No. 12/124,891 filed May 21, 2008; Ser. No. 12/259,838 filed Oct. 28, 2008; and Ser. No. 12/407,260 filed Mar. 19, 2009, all of which are incorporated by reference herein in their entirety. Additives such as the oxidation catalyst particles 40 can be added to a filter tow by any known process, such as by addition of the particles during the tow blooming process.

Filter elements of the present invention can be incorporated within conventional cigarettes configured for combustion of a smokable material, and also within the types of cigarettes set forth in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,989,619 to Clearman et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,027,836 to Shannon et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,052,413 to Baker et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,396,911 to Casey, III et al.; U.S. Pat. No. 5,551,451 to Riggs et al.; U.S. Pat. No. 5,595,577 to Bensalem et al.; U.S. Pat. No. 5,727,571 to Meiring et al.; U.S. Pat. No. 5,819,751 to Barnes et al.; U.S. Pat. No. 6,089,857 to Matsuura et al.; U.S. Pat. No. 6,095,152 to Beven et al; and U.S. Pat. No. 6,578,584 to Beven; which are incorporated herein by reference. Still further, filter elements of the present invention can be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference.

Cigarette rods typically are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,131,416 to Gentry; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; and U.S. Pat. No. 6,904,917 to Kitao et al.; and US Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al.; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and US Patent Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

The dimensions of a representative cigarette can vary. Preferred cigarettes are rod-shaped, and can have diameters of about 7.5 mm (e.g., circumferences of about 20 mm to about 27 mm, often about 22.5 mm to about 25 mm); and can have total lengths of about 70 mm to about 120 mm, often about 80 mm to about 100 mm. The length of the filter element 26 can vary. Typical filter elements can have total lengths of about 15 mm to about 40 mm, often about 20 mm to about 35 mm. For embodiments where the smoke-altering material 40 is present only in a portion of the filter length, the length of the filter element containing the smoke-altering material is typically about 5 mm to about 20 mm, often about 10 mm to about 15 mm.

Preferred cigarettes of the present invention exhibit desirable resistance to draw. For example, an exemplary cigarette exhibits a pressure drop of between about 50 and about 200 mm water pressure drop at 17.5 cc/sec air flow. Preferred cigarettes exhibit pressure drop values of between about 60 mm and about 180 mm, more preferably between about 70 mm to about 150 mm, water pressure drop at 17.5 cc/sec air flow.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A filter element of a smoking article having a longitudinal axis and adapted for filtration of mainstream smoke generated by the smoking article, comprising a first region extending along the longitudinal axis of the filter element and exhibiting a first pressure drop and a second region extending along the longitudinal axis of the filter element and exhibiting a second pressure drop lower than said first pressure drop, wherein the first and second regions are arranged in a side-by-side configuration such that both regions are visible in a cross-section of the filter element perpendicular to the longitudinal axis, wherein gaseous species of mainstream smoke can move from the second region into the first region, and further comprising a smoke-altering material positioned in the first region, wherein both the first region and the second region comprise a fibrous tow filter material and the smoke-altering material is imbedded in the fibrous tow filter material of the first region, and further wherein the difference in pressure drop between the first region and the second region results from filaments in each region having a different cross-sectional shape or a different denier per filament.

2. The filter element of claim 1, wherein the fibrous tow filter material of the first region comprises filaments having a lower weight per unit length than the filaments of fibrous tow filter material of the second region.

3. The filter element of claim 2, wherein the fibrous tow filter material of the first region comprises filaments having a weight per unit length that is no more than about 50% of the weight per unit length of the filaments of the second region.

4. The filter element of claim 1, wherein the ratio of the pressure drop of the first region compared to the second region is at least about 1.5:1.

5. The filter element of claim 4, wherein the ratio of the pressure drop of the first region compared to the second region is at least about 2.5:1.

6. The filter element of claim 1, wherein the first region is positioned annularly around the second region.

7. The filter element of claim 6, wherein the smoke-altering material is an oxidation catalyst.

8. The filter element of claim 7, wherein the fibrous tow filter material of the first region comprises filaments having a lower weight per unit length than the filaments of fibrous tow filter material of the second region.

9. The filter element of claim 8, wherein the fibrous tow filter material of the first region comprises filaments having a weight per unit length that is no more than about 50% of the weight per unit length of the filaments of the second region.

10. The filter element of claim 6, wherein the first region and the second region comprise filaments having a different cross-sectional shape, the filaments in the first region having a Y or X cross-sectional shape and the filaments in the second region having a round cross-sectional shape.

11. The filter element of claim 6, further comprising one or more layers of wrapping material circumscribing the filter element, wherein at least one layer of wrapping material exhibits a diffusivity of at least about 1 cm/sec.

12. The filter element of claim 6, wherein the ratio of the pressure drop of the first region compared to the second region is at least about 1.5:1.

13. The filter element of claim 1, further comprising one or more layers of wrapping material circumscribing the filter element, wherein at least one layer of wrapping material exhibits a diffusivity of at least about 1 cm/sec.

14. The filter element of claim 1, wherein the smoke-altering material is an oxidation catalyst.

15. The filter element of claim 14, wherein the oxidation catalyst is a catalytic metal compound comprising an element selected from the group consisting of alkali metals, alkaline earth metals, transition metals in Groups IIIB, IVB, VB, VIB VIIB, VIIIB, IB, and IIB, Group IIIA elements, Group IVA elements, lanthanides, and actinides.

16. The filter element of claim 15, wherein the catalytic metal compound is selected from the group consisting of iron oxide, copper oxide, zinc oxide, cerium oxide, palladium, platinum, rhodium, halides of palladium, platinum or rhodium, nitrates of palladium, platinum or rhodium, and combinations thereof.

17. The filter element of claim 1, wherein the smoke-altering material is in powdered or granular form.

18. The filter element of claim 1, wherein the first region and the second region comprise filaments having a different cross-sectional shape, the filaments in the first region having a Y or X cross-sectional shape and the filaments in the second region having a round cross-sectional shape.

19. A cigarette comprising a tobacco rod having a smokable filler material contained within a circumscribing wrapping material and a filter element according to claim 1 connected to the tobacco rod at one end of the tobacco rod.

20. A cigarette comprising a tobacco rod having a smokable filler material contained within a circumscribing wrapping material and a filter element according to claim 6 connected to the tobacco rod at one end of the tobacco rod.

* * * * *